US006612297B2

(12) United States Patent
Mizuki

(10) Patent No.: US 6,612,297 B2
(45) Date of Patent: Sep. 2, 2003

(54) METHOD OF CONTROLLING AN ENGINE STARTUP

(75) Inventor: Toru Mizuki, Fujisawa (JP)

(73) Assignee: Isuzu Motors Limited, Tokyo (JP)

( * ) Notice: Subject to any disclaimer, the term of this patent is extended or adjusted under 35 U.S.C. 154(b) by 47 days.

(21) Appl. No.: 10/027,118

(22) Filed: Dec. 20, 2001

(65) Prior Publication Data

US 2002/0078922 A1 Jun. 27, 2002

(30) Foreign Application Priority Data

Dec. 26, 2000 (JP) ..... 2000-395620

(51) Int. Cl.[7] ..... F02D 41/06

(52) U.S. Cl. ..... 123/686; 123/362; 123/687; 123/451

(58) Field of Search ..... 123/685, 686, 123/687, 491, 352, 362

(56) References Cited

U.S. PATENT DOCUMENTS 4,964,386 A 10/1990 Akiyama et al. ..... 123/339
5,558,076 A * 9/1996 Maki et al. ..... 123/687
5,590,638 A * 1/1997 Nishimura et al. ..... 123/687
5,720,265 A * 2/1998 Maki et al. ..... 123/687
5,960,773 A * 10/1999 Shino et al. ..... 123/686

FOREIGN PATENT DOCUMENTS

DE 197 40 192 A1 3/1999
GB 2 146 800 A 4/1985

OTHER PUBLICATIONS

Copy of European Search Report Ser. No. EP 01 13 0731 dated May 16, 2003.

* cited by examiner

*Primary Examiner*—Erick Solis
(74) *Attorney, Agent, or Firm*—McCormick, Paulding & Huber LLP

(57) ABSTRACT

A method providing solution of both of the problem of black smoke during the engine startup period and the problem of undershooting and hunting at the settling time. By adding at least an integral term QI to a basic injection quantity, feedback control of a fuel injection quantity of an engine is carried out. An initial integral term QI0, which is used during the engine startup, is predetermined. During the engine startup period, the integral term QI is set as "0" until an engine revolution number Ne reaches a predetermined startup revolution number Nes. When the Ne reaches the Nes, the initial integral term QI0 is used as the QI. The QI0 is preferably determined on the basis of one of, or both of, a water temperature and an atmospheric temperature. The Nes is preferably a value close to, or equal to, an idling revolution number Nei.

4 Claims, 4 Drawing Sheets

| | WATER TEMPERATURE |
|---|---|
| ATMOSPHERIC TEMPERATURE | INITIAL INTEGRAL TERM |

METHOD OF CONTROLLING AN ENGINE STARTUP

CROSS REFERENCES TO RELATED APPLICATIONS

This application claims priority under 35 USC 119 of Japanese Patent Application No. 2000-395620 filed in JPO on Dec. 26, 2000, the entire disclosure of which is incorporated herein by reference.

BACKGROUND OF THE INVENTION

1. Field of the Invention

The present invention relates to a method of controlling a startup of an engine. More particularly, the present invention relates to a method of controlling an engine startup in which characteristics of starting up an engine can be improved.

2. Description of the Related Art

In idling control of an electronically controlled diesel engine, usually feedback control of a normal fuel injection quantity is carried out. In this case, every predetermined control timing, a next fuel injection quantity is calculated by adding a proportional term (this term will be also called a P term hereinbelow) and an integral term (this term will be also called an I term hereinbelow) to a basic injection quantity, and an actual injection quantity is successively corrected so as to bring the quantity closer to a target injection quantity.

During an engine startup period, after cranking revolution is started, combustion begins. Revolution of the engine rises up once, and then settles into a predetermined idling revolution number. However, at the same time the cranking begins, the I term starts with zero value, and calculation of addition is carried out every moment. For example, when it is cold, if a cranking period is long, a fuel quantity exceeds a proper quantity at the time combustion starts (the state where ignition occurs), and black smoke is generated. On the other hand, if the cranking period is short (for example, after warmup is carried out), undershooting or/and hunting occurs due to lack of a fuel quantity at the time the engine revolution number settles into the idling revolution number. As stated above, it has been difficult to solve the problem of black smoke together with the problem of undershooting when the engine revolution number settles into the idling revolution number.

SUMMARY OF THE INVENTION

It is an object of the present invention to provide a method of controlling an engine startup in which feedback control of fuel injection quantity is performed by adding at least an integral term (I term) to a basic injection quantity of the engine. Further, in this method, an initial integral term, which is used during an engine startup, is determined in advance. Furthermore, in this method, during the engine startup, the integral term is set to be "0" until an engine revolution number reaches a startup revolution number, and when the engine revolution number reaches the startup revolution number, the initial integral term is used as the integral term.

The initial integral term is preferably determined on the basis of one of, or both of, a water temperature and an atmospheric temperature.

The startup revolution number is preferably a value higher than a cranking revolution number and lower than a complete combustion revolution number.

The startup revolution number is preferably a value close to, or equal to, an idling revolution number.

Additional objects, aspects, benefits and advantages of the present invention will become apparent to those skilled in the art to which the present invention pertains from the subsequent detailed description and the appended claims, taken in conjunction with the accompanying drawings.

BREIF DESCRIPTION OF THE DARAWINGS

DETAILED DESCRIPTION OF THE INVENTION

An preferred embodiment of the present invention will be described, based on the accompanying drawings, and in comparison with conventional methods of controlling an engine startup in order to facilitate understanding of a method and advantages of the present invention. In this embodiment, an engine revolution number is used as an engine revolution speed.

Figure 7:
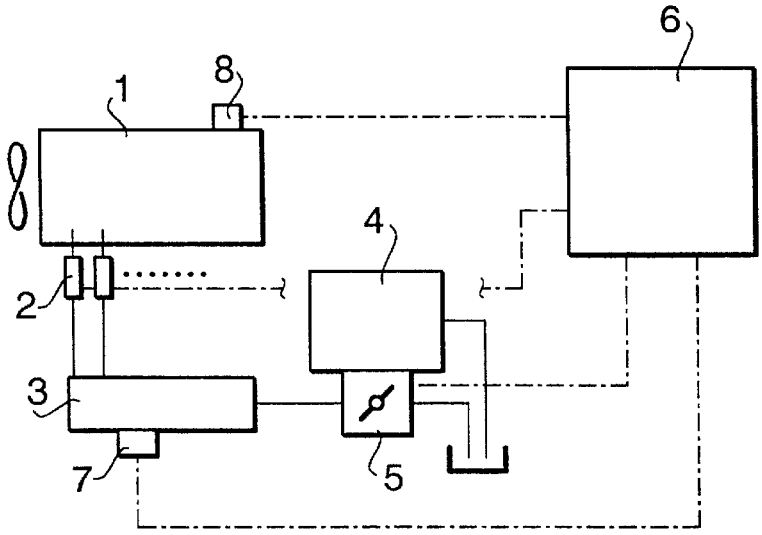
FIG. 7 is a structural illustration showing an engine in the embodiment of the present invention.

An engine in this embodiment is a known common rail type diesel engine whose structure is shown in FIG. 7. In an engine 1, fuel is injected into each cylinder from an injector 2. The pressurized fuel is accumulated in a common rail 3. A supply pump 4 supplies the fuel by pressure to the common rail 3, an electronic control unit (ECU) 6 properly switches a pressure control valve 5 to a supply side from a leak side or to the leak side from the supply side, and thereby a common rail pressure is controlled. The common rail pressure is detected by a common rail pressure sensor 7, and is controlled by feedback in order to obtain an optimum value. The ECU 6 has a role of controlling fuel injection, and controls a fuel injection quantity by controlling the period for which electric current is supplied to the injector 2. During idling, a fuel injection quantity is controlled by feedback on the basis of output from an engine revolution sensor 8. In addition to that, the ECU 6 receives other kinds of information indicating an engine operation state from an accelerator opening sensor, a water temperature (engine temperature) sensor, an atmospheric temperature sensor, and so forth.

Figures 4, 5:
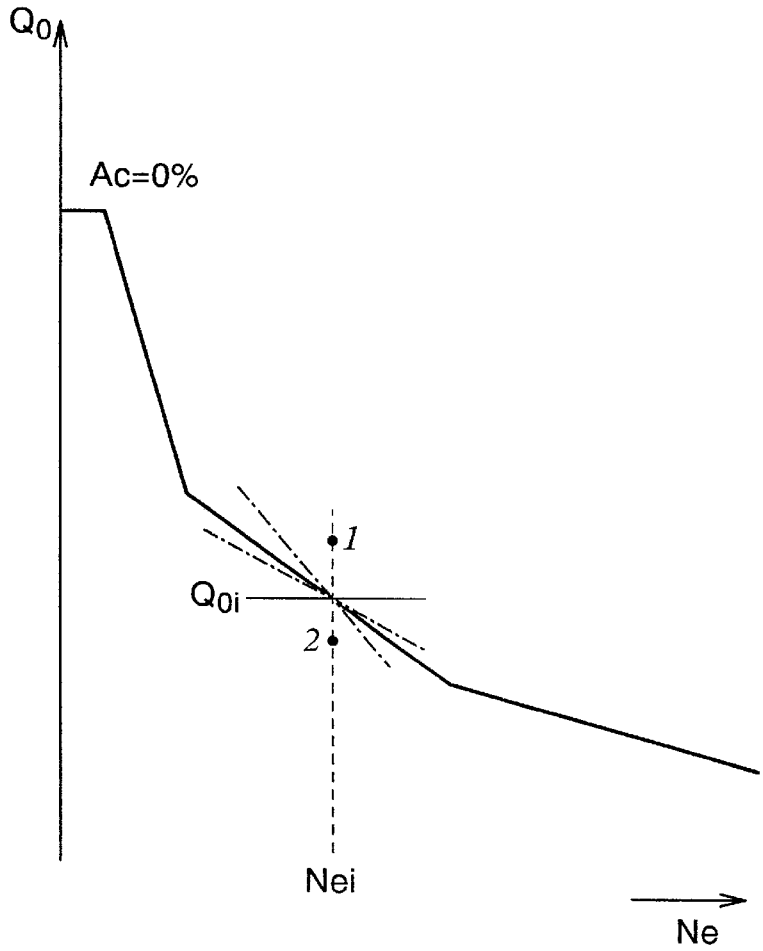
FIG. 4 is a map showing a basic injection quantity when an accelerator opening is 0%.
FIG. 5 is a two-dimensional map for determining an initial integral term.

In an idling state, feedback control of a fuel injection quantity is carried out. This feedback control is as follows. FIG. 4 shows a basic injection quantity Q0 which is injected every engine revolution number Ne when an accelerator opening Ac is 0%. When a target revolution number of the engine is set as an idling revolution number Nei (for example, 440 rpm), a basic injection quantity is Q0i. Actually, there are many cases in which even if the basic injection quantity Q0i is injected, an actual engine revolution number is not equal to the idling revolution number Nei due to difference in using condition such as a warmup state of the engine, or an outside air temperature. That is, there are many cases in which the fuel injection quantity is required to be increased or decreased as indicated by the numeral 1 or 2 of FIG. 4. Therefore, by adding a proportional term (P term) QP and an integral term (I term) QI to the basic injection quantity Q0i, the fuel injection quantity is corrected so as to bring the actual engine revolution number closer to the idling revolution number Nei. In other wards, a final injection quantity Qn is calculated by using the equation: Qn=Q0i+QP+QI.

The feedback control as stated above is carried out every predetermined timing. Although the above description is directed to the case of an idling operation, when the accelerator opening Ac is 0%, the final injection quantity can be determined in the same manner also in the case where a state of the engine is not in idling.

Figure 2:
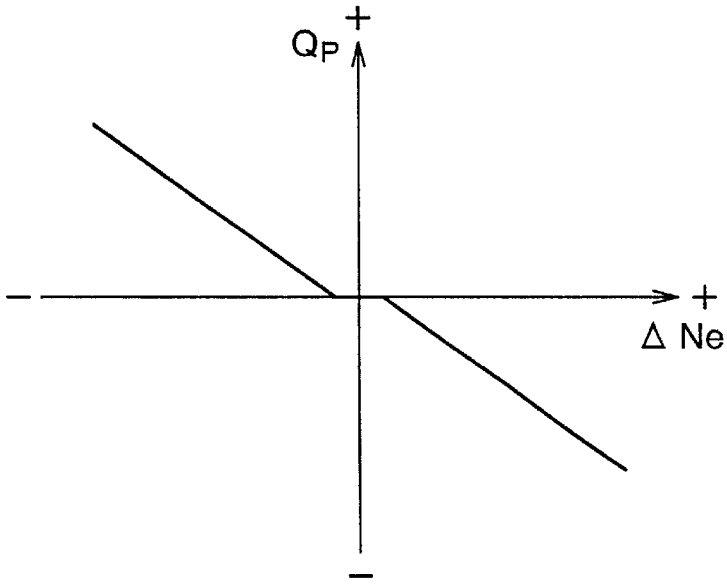
FIG. 2 is a table for calculating the P term.

The P term is determined from a table of FIG. 2 which was stored in the ECU 6. In other wards, the value QP of the P term is determined as one value on the basis of difference between the actual engine revolution number and the target revolution number. More specifically, the value QP is determined on the basis of difference ΔNe which is the actual engine revolution number minus the target revolution number. When the ΔNe is "0" or close to "0", the value QP is "0". The larger the ΔNe becomes from the value close to "0", the smaller the value QP of the P term becomes (that is, the more the QP moves in a direction of the minus side). On the other hand, the smaller the ΔNe becomes from the value close to "0", the larger the QP becomes (that is, the more the QP moves in a direction of the plus side). The QP of the term P causes the inclination of FIG. 4 to change (refer to the dashed line), and updates its own value every control timing.

Figure 3:
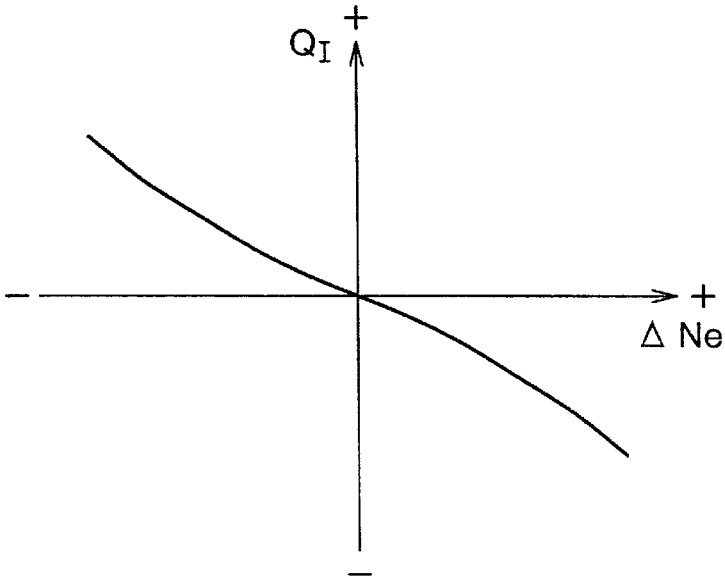
FIG. 3 is a table for calculating the I term.

The I term is determined from a table of FIG. 3 which was stored in the ECU 6. The value QI of the I term is also determined as one value on the basis of the ΔNe. In many cases, the graph of the QI crosses at the origin of the coordinate axis. Generally, only when the ΔNe is "0", the value QI is "0". The larger the ΔNe becomes from "0", the smaller the value QI becomes (that is, the more the QI moves in a direction of the minus side). On the other hand, the smaller the ΔNe becomes from "0", the larger the QI becomes (that is, the more the QI moves in a direction of the plus side).

The value QI of the I term causes the actual engine revolution number to converge at the target revolution number when the actual engine revolution number reaches the target revolution number. The description regarding this matter will be presented later. The value QI is updated every control timing, and calculation of addition is carried out every timing. As known to those skilled in the art, this calculation of addition may be carried out such that if the current I term is QI(n) and the previous I term is QI(n−1), the current I term QI(n) is determined by adding the QI obtained from FIG. 3 to the previous I term QI(n−1). Thus, in the equation of "Qn =Q0i+QP+QI", this QI indicates the current QI(n) of the I term.

Figure 1:
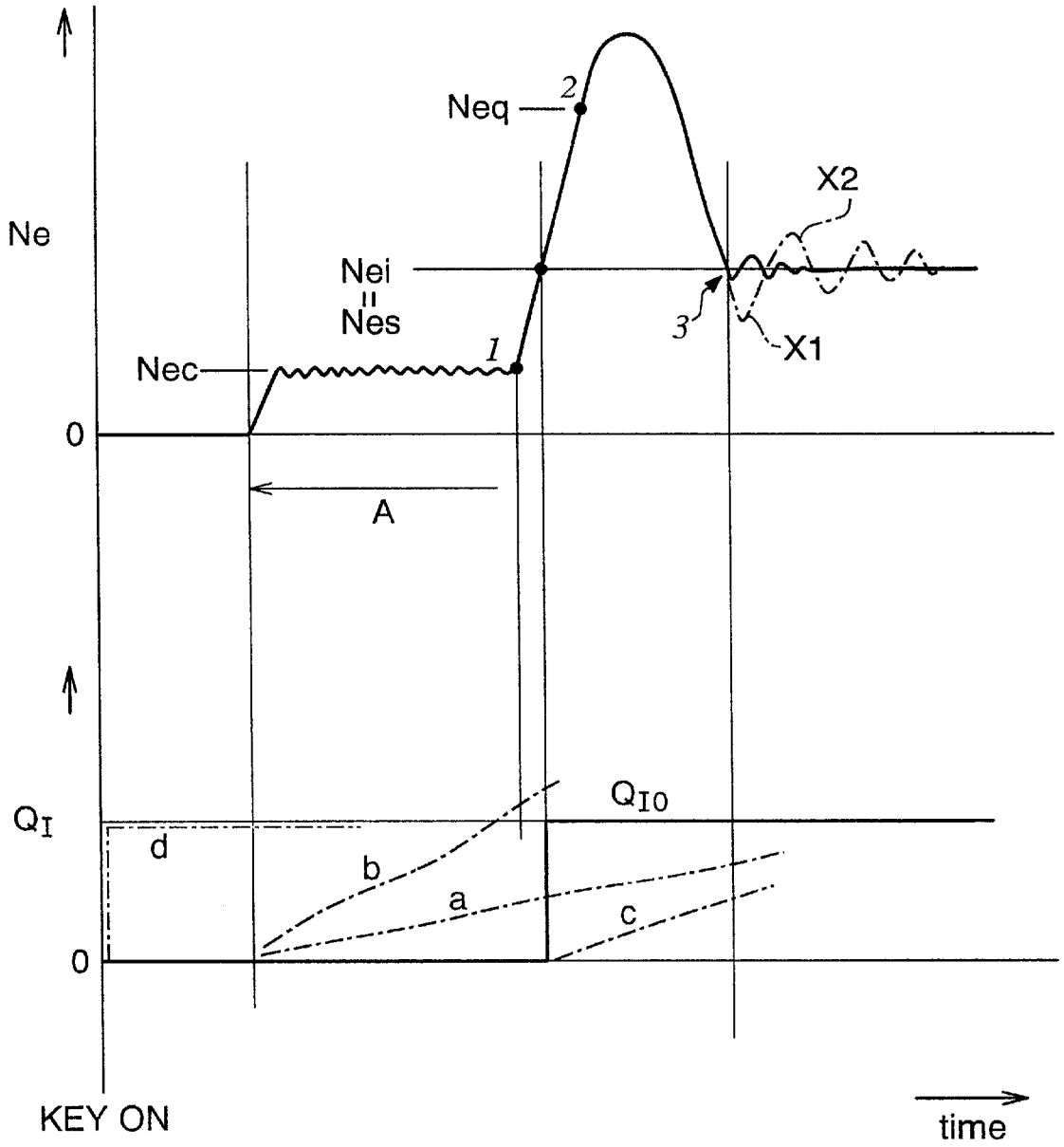
FIG. 1 is a time chart showing a method of controlling startup of an engine according to an embodiment of the present invention.

FIG. 1 shows condition during the engine startup period. On the assumption that an accelerator is not depressed and the accelerator opening Ac is 0%, the condition of the engine will be described. In the case of the engine startup, after a predetermined period passes from the time an engine key is changed to ON, cranking is started. The time the engine is started up may be the time the cranking begins. A cranking period is indicated by "A", but an end time of the cranking is varied depending on a driver. When combustion begins, the engine revolution number Ne (that is, engine revolution speed) rises up rapidly, the engine leads to a complete combustion state, and then the engine revolution number drops to settle into an idling revolution number Nei (that is, stabilized). The numeral 1 indicates the timing that the combustion begins, and the numeral 2 indicates the timing that the engine state reaches complete combustion. The complete combustion timing 2 is generally timing preceding the time when the engine revolution rises up to the most high point. Of course, an engine revolution number Neq at the complete combustion timing (for example, 1000 rpm) is greater than the idling revolution number Nei. A cranking revolution number Nec (for example, 100 rpm) is lower than the idling revolution number Nei, but the Nec can vary in accordance with an engine warmup condition, a storage condition of a battery, or the like. The engine revolution number at the combustion start time 1 has a certain width (or example, 150 to 200 rpm), is a little larger than the cranking revolution number Nec, and of course is smaller than the idling revolution number Nei.

Furthermore, a startup revolution number Nes is predetermined. In other words, this startup revolution number is a predetermined startup revolution speed. The Nes is used for making judgment during the engine startup period when the engine control is carried out (this judgment will be understood later). The startup revolution number Nes is determined for each engine by a test of an actual engine or the like, and the value of the Nes is stored in the ECU 6. The startup revolution number Nes is generally a larger than the cranking revolution number Nec and smaller than the complete combustion revolution number Neq. For the sake of convenience, assuming that the startup revolution number Nes is equal to the idling revolution number Nei, this example is described, but strictly speaking this assumption does not necessarily corresponds to an actual case.

Also during this startup period, the above-mentioned feedback control is carried out. Every moment, the fuel injection quantity is calculated by using the equation: Qn=Q0i+QP+QI.

In a conventional manner, as indicated by "a" of FIG. 1, an initial value of the I term QI is set as "0", and the value QI is increased every moment from the time cranking begins. However, when the engine startup is in an ill condition such as a cold day, nighttime, use of a heater, or difference in individuals (drivers), the cranking period A becomes longer. Therefore, there is a problem. In other words, as indicated by "b" of FIG. 1, the value QI of the I term leads to an overshooting value (assuming that an optimum value is indicated by QI0), and black smoke is generated at the same time combustion begins. On the other hand, when the engine startup is in a good condition, the cranking period A becomes short, so that the value QI of the I term becomes smaller than a desired value, as indicated by "a" of FIG. 1, at the time when the time reaches the settling timing 3. As indicated by "x1" of FIG. 1, undershooting occurs, and in the worst case, the engine stops (en-st occurs). Furthermore, as indicated by "x2" of FIG. 1, hunting occurs, and there is a problem that the engine revolution number Ne takes some time to converge at the idling revolution number Nei.

Also during this startup period, the above-mentioned feedback control is carried out, so that the value QI of the I term at the cranking time becomes an almost constant value which is determined as one value from a table of FIG. 3 and the equation: ΔNe=Nec−Ne. Therefore, since whether the startup condition is good or bad is not taken into account, such a problem occurs. In a conventional manner, it has been thus difficult to solve both the problem of startup black smoke and the problem of undershooting or hunting at the settling time, and to set the compatible I term.

There has been following conventional methods of solving this problem. In a first conventional method, as indicated by "c" of FIG. 1, calculation of the I term is stopped and the I term stays at the value "0" until the engine revolution number Ne reaches the startup revolution number Nes. When the engine revolution number Ne reaches the startup revolution number Nes, the calculation of the I term is started. However, although this method prevents black smoke from generating, even when the engine condition reaches settling time 3, the value of the I term is insufficient, so that undershooting or hunting occurs. In this case, if a table of FIG. 3 is arranged and prepared so as to provide a sufficient I term at the settling time 3, hunting occurs at the time of a normal free accelerating (racing of the engine).

In a second conventional method, as indicated by "d" of FIG. 1, a high I term is given from the beginning. However, in this case, black smoke is generated because the fuel quantity becomes larger than a necessary quantity at the combustion start time 1.

In a third conventional method, the calculation of the I term is started from the cranking start time as indicated by "a" of FIG. 1, but does not affect the calculation of the final injection quantity (that is, although calculation is performed, the I term is set as "0"). When and after the time reaches the combustion start time 1, the I term is calculated and increased so as to affect the injection quantity (that is, the I term is made to appear). In this manner, in the case where the cranking period A is short, black smoke is prevented from generating, but undershooting or the like occurs at the settling time 3. In the case where the cranking period A is long, the problem that black smoke is generated is not solved as ever.

With the view of the foregoing, the present invention adopts the following method of controlling a startup of the engine. In other words, an initial integral term (an initial I term) QI0 is predetermined. The I term is set as "0" until the engine revolution number reaches the startup revolution number Nes. (That is, the integral term is held at a value of "0" from engine start to the time that the engine revolution speed reaches a predetermined startup revolution speed.) When the engine revolution number reaches the startup revolution number Nes, the initial integral term QI0 is used as the I term.

More detailed description of the method according to the present invention is as follows. First, the value of the startup revolution number Nes is determined as an optimum value which may be different from the conventional value. According to the test of the actual engine an inventor performs, the value of the Nes is preferably set as a value close to or equal to the idling revolution number Nei. In this embodiment according to the present invention, the value of Nes is set as a value equal to the idling revolution number Nei (for example, 440 rpm).

Secondly, an optimum value of the initial I term QI0 can be determined by testing the actual engine or the like on the basis of various parameters concerning a startup condition or requirement. This determined optimum value is also stored in the ECU 6. In this embodiment according to the present invention, the initial I term QI0 is determined on the basis of a two-dimensional map of a water temperature and an atmospheric temperature as shown in FIG. 5. It should be noted that the initial I term QI0 may be determined on the basis of either the water temperature or the atmospheric temperature.

The following is the method of controlling the startup of the engine in the embodiment according to the present invention (specifically, the method of carrying out revolution feedback control during an engine startup period by controlling fuel injection quantity, in which the fuel injection quantity is determined by adding at least fuel quantity correction based on an integral term to a basic fuel injection quantity). The condition of this embodiment is shown by the solid line of FIG. 1. First, the I term is set to be "0" during the cranking period A from the time key is changed to ON. Furthermore, even when time reaches the combustion start time 1, the I term still remains "0". After the combustion start time 1, the I term continues to be "0" until the engine revolution number reaches the startup revolution number Nes. At the moment when the engine revolution number reaches the startup revolution number Nes, the initial I term QI0 is used as the I term.

In other words, at the moment when the engine revolution number reaches the startup revolution number Nes, the initial I term QI0 is made to appear. After the initial I term QI0 appears, the I term QI that follows the table of FIG. 3 is used to perform the calculation of the final injection quantity.

According to this method, since the calculation of addition regarding the I term is practically not performed during cranking, even if the cranking period A becomes long, the fuel quantity is not set to be an exceeding quantity, and black smoke can be prevented from being generated. In addition, immediately after combustion is started, the initial I term that is larger than a conventional value (a conventional initial value is "0") can be provided, so that when the time reaches the settling time 3, the fuel quantity does not become insufficient, and undershooting or hunting can be prevented. In this manner, black smoke generation during the startup period and undershooting and hunting at the settling time can be prevented together.

The initial I term is preferably generated after the combustion start time 1 in order to prevent black smoke generation. It should be noted that generation of the initial I term is preferably advanced in order to use a sufficiently accumulated optimum I term at the settling time 3. Therefore, the startup revolution number Nes, which can determine the time when the I term is generated, is preferably set as a value at least greater than the cranking revolution number Nec and smaller than a complete combustion revolution number Neq.

Figure 6:
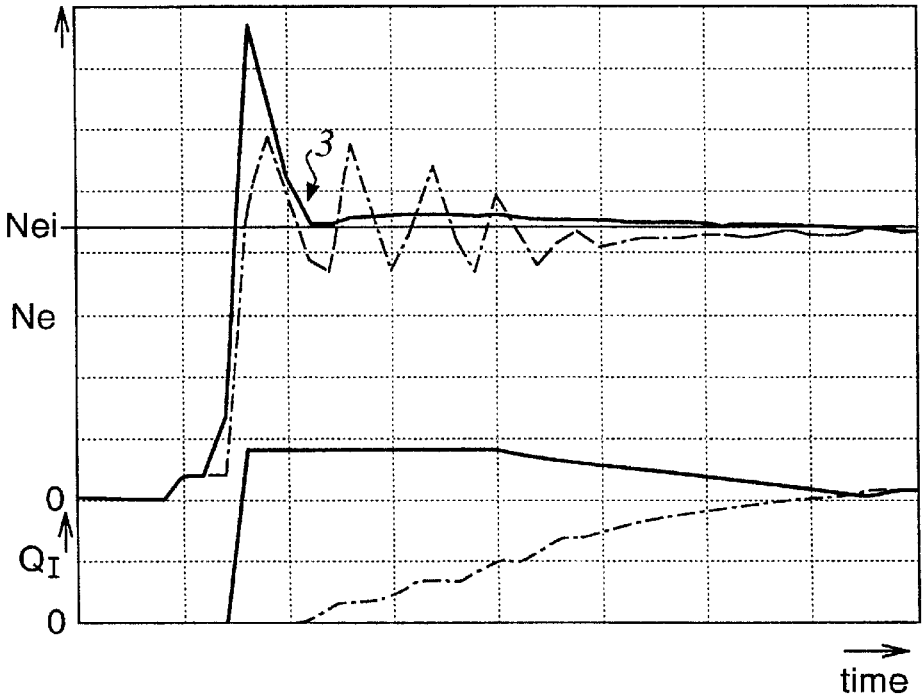
FIG. 6 is a time chart showing results of engine tests of an embodiment according to the present invention and an example of a conventional manner.

FIG. 6 shows a result of the engine test performed in order to compare this embodiment according to the present invention with an example of a conventional manner. This embodiment according to the present invention is indicated by the solid line, and the example of the conventional manner is indicated by the one-dot dashed line. As the example of the conventional manner, the above-mentioned first conventional method is adopted. As shown in FIG. 6, in the case where the embodiment according to the present invention is employed, undershooting and hunting completely disappear. Specifically, at the settling time 3, the engine revolution number Ne gently settles into the idling revolution number Nei from a higher point, and a desirable result that there is no sinking can be obtained. Of course, black smoke is not generated, and the advantages of the present invention are confirmed by this test of the actual engine.

An embodiment of the present invention is not limited to the above-mentioned embodiment. For example, the present invention can be applied to an embodiment in which the P term is not used to determine the final fuel injection. The present invention can be applied to any electronically controlled engine. Of course, the present invention can be applied to a diesel engine and a gasoline engine, but other type engines may be adopted to the present invention. Furthermore, in the case of a diesel engine, the present invention can be applied to not only a common rail type engine but also an electronically controlled fuel injection pump type engine (for example, an engine having an electronic governor). Moreover, the present invention can be applied to even a gas turbine engine.

As a result, according to the present invention, an outstanding advantage that it is possible to solve both the problem of black smoke during the engine startup period and the problem of undershooting or hunting at the settling time can be accomplished. In this embodiment, the term "revolution number" is used to represent an engine revolution speed. For example, an idling revolution number Nei and a cranking revolution number Nec are respectively used for representing an idling revolution speed and a cranking revolution speed.

What is claimed is:

1. A method of carrying out revolution feedback control during an engine startup period by controlling fuel injection quantity, in which the fuel injection quantity is determined by adding at least fuel quantity correction based on an integral term to a basic fuel injection quantity, said method comprising:

(a) holding the integral term at a value of "0" from engine start to the time that an engine revolution speed reaches a predetermined startup revolution speed; and (b) setting a predetermined initial integral term as the integral term at the time that the engine revolution speed reaches the predetermined startup revolution speed.

2. The method according to claim 1, wherein the initial integral term is determined on the basis of one of, or both of, a water temperature and an atmospheric temperature.

3. The method according to claim 1, wherein the startup revolution speed is a value higher than a cranking revolution speed and lower than a complete combustion revolution speed.

4. The method according to claim 1, wherein the predetermined startup revolution speed is approximately a value of an idling revolution speed.

* * * * *